United States Patent [19]

Fischer

[11] Patent Number: 4,989,294

[45] Date of Patent: Feb. 5, 1991

[54] FLOOR CLEANING TOOL FOR VACUUM CLEANER

[75] Inventor: Ernest J. Fischer, Skokie, Ill.

[73] Assignee: Breuer Electric Mfg. Co., Chicago, Ill.

[21] Appl. No.: 386,959

[22] Filed: Jul. 28, 1989

[51] Int. Cl.[5] ..... A47L 9/02

[52] U.S. Cl. ..... 15/415.1; 15/393

[58] Field of Search ..... 15/415 R, 393, 397

[56] References Cited

U.S. PATENT DOCUMENTS

| | | | |
|---|---|---|---|
| 1,039,383 | 9/1912 | Goughnour | 15/415 R |
| 1,057,347 | 3/1913 | Kenney | 15/415 R |
| 2,130,635 | 9/1938 | Dow et al. | 15/397 |
| 4,011,624 | 3/1977 | Proett | 15/415 R X |
| 4,633,543 | 1/1987 | Sovis et al. | 15/344 |

FOREIGN PATENT DOCUMENTS

| | | | |
|---|---|---|---|
| 413658 | 5/1946 | Italy | 15/415 R |

*Primary Examiner*—Chris K. Moore

*Attorney, Agent, or Firm*—Juettner Pyle Lloyd & Verbeck

[57] ABSTRACT

A plastic floor cleaning tool for a vacuum cleaner is characterized by two injection molded plastic pieces that are joined to form an integral structure. By using two plastic pieces to form the floor tool, each may be injection molded to a configuration such that, when they are joined, the floor tool has an aerodynamically shaped interior air flow chamber. The aerodynamically shaped chamber improves the air flow through the floor tool, so that a powerful vortex action is generated at floor level, suction is intensified and debris is aerodynamically airswept through smooth, contoured channels in the floor tool at full force and without encountering acute bends in the air flow path.

14 Claims, 2 Drawing Sheets

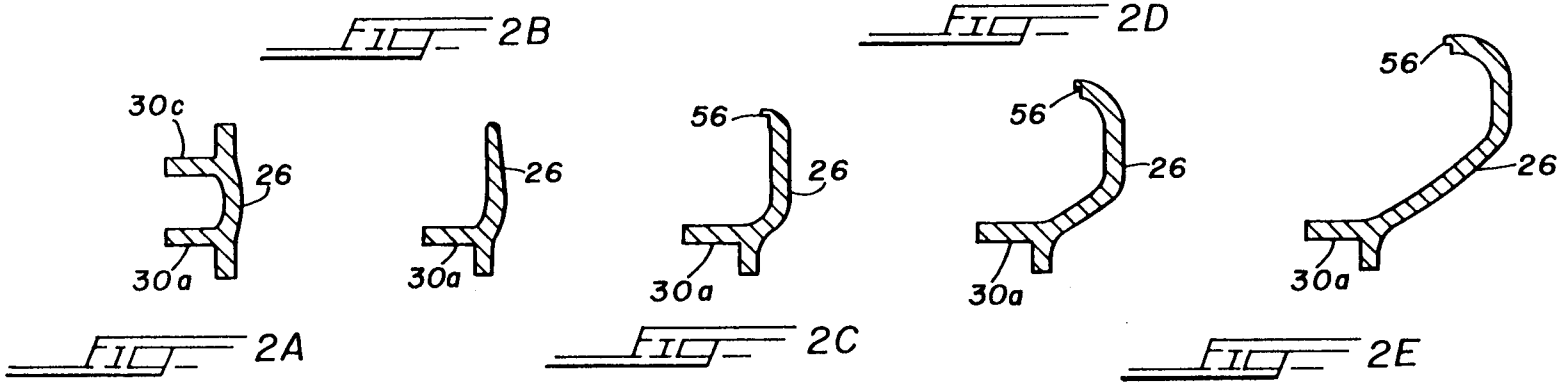
FIG. 2A
FIG. 2B
FIG. 2C
FIG. 2D
FIG. 2E
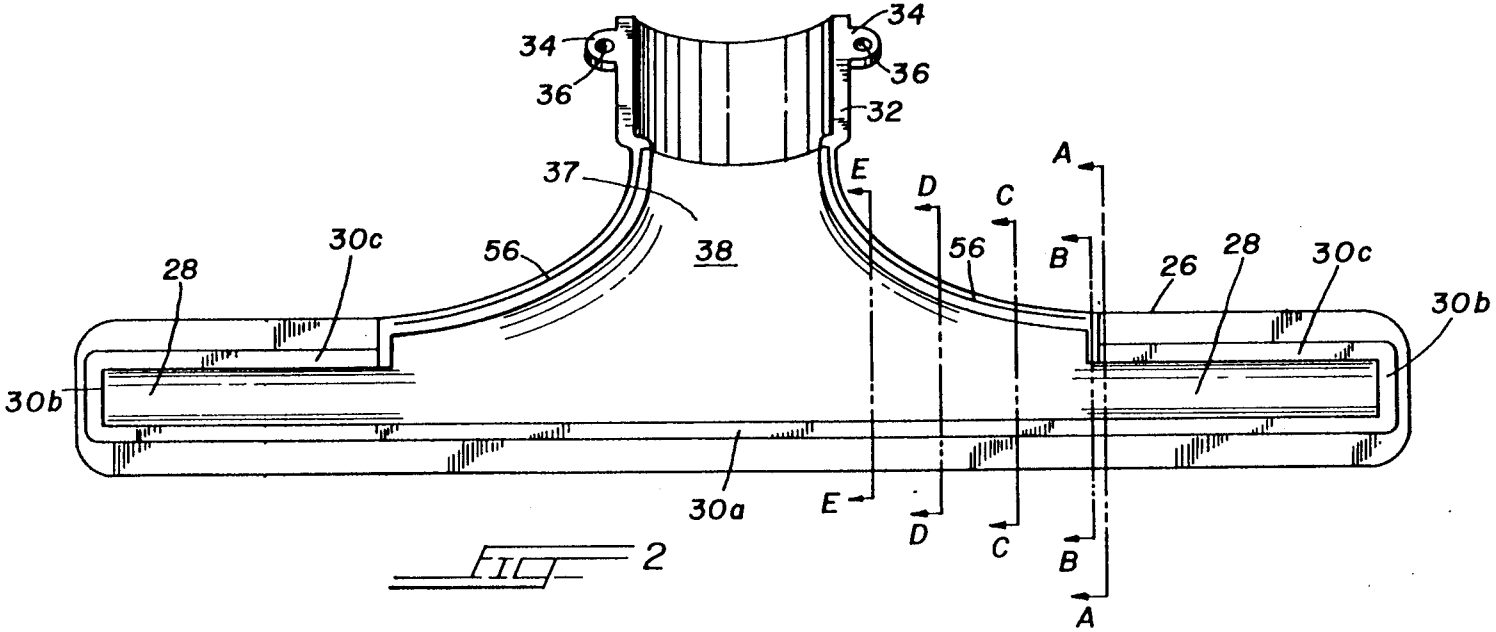
FIG. 2

FLOOR CLEANING TOOL FOR VACUUM CLEANER

BACKGROUND OF THE INVENTION

The present invention relates to floor cleaning tools for vacuum cleaners, and in particular to an improved plastic floor tool that is formed from two integrally joined injection molded plastic pieces.

There are several types of commercially available floor tools for attachment to the end of a wand of a vacuum cleaner. The most popular are sand cast aluminum tools, which are expensive to make and usually have aerodynamically shaped interior chambers to improve air flow. Because these tools are aluminum, the aerodynamic shapes of the interior chambers are easy to form by using sand cores and then collapsing the sand to remove the cores.

In an effort to reduce the cost of floor tools, steel and one piece plastic tools have been developed with simple box-shaped interior chambers or, at best, chambers with relatively smooth flowing edges. An aerodynamic interior chamber is not formed in such tools since the materials used, steel and injection molded plastic, do not allow such chambers to be easily formed when the tools are initially fabricated as one piece structures. These floor tools therefore are not as efficient in operation as are the above mentioned aluminum tools.

OBJECTS OF THE INVENTION

The primary object of the present invention is to provide an improved plastic floor tool for use with a vacuum cleaner, which has an aerodynamically shaped interior chamber that improves a flow of air through the tool.

Another object is to provide such a plastic floor tool, which is formed from two separate injected molded plastic pieces that are configured, when connected together, to define the aerodynamically shaped interior chamber of the tool.

SUMMARY OF THE INVENTION

In accordance with the present invention, there is provided an improved floor tool for vacuum cleaning surfaces. The floor tool comprises first and second injection molded plastic housings, each configured to define part of an air inlet to, an air outlet from and an aerodynamically shaped interior air flow chamber of the floor tool. The first and second housings are initially molded as separate housings, and means are provided for integrally joining the housings together to form the floor tool having the air inlet thereto, the air outlet therefrom and the aerodynamically shaped chamber between the air inlet and outlet. The chamber defines a smoothly contoured flow path for air between the air inlet and outlet.

The invention also contemplates a method of making a plastic floor tool for vacuum cleaning surfaces, which comprises the step of injection molding first and second separate plastic housings to each have part of an air inlet to, an air outlet from and an aerodynamically shaped interior air flow chamber of the floor tool. Also included is the step of integrally joining the housings together to form the floor tool having the air inlet thereto, the air outlet therefrom and the aerodynamically shaped chamber between the air inlet and outlet, with the aerodynamically shaped chamber defining a smoothly contoured flow path for air between the air inlet and outlet.

The foregoing and other objects, advantages and features of the invention will become apparent upon a consideration of the following detailed description, when taken in conjunction with the accompanying drawings.

BRIEF DESCRIPTION OF THE DRAWINGS

FIG. 2 is a bottom plan view of an injection molded plastic top piece of the floor tool;

FIGS. 2A–2E are cross sectional views taken substantially along the lines A—A through E—E of FIG. 2;

DETAILED DESCRIPTION

Figure 1:
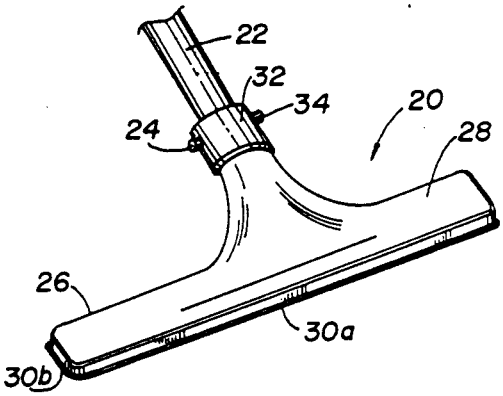
FIG. 1 is a top perspective view of a plastic floor tool made according to the teachings of the invention, showing the tool attached to the end of a wand of a vacuum cleaner.

FIG. 1 illustrates a plastic floor cleaning tool, indicated generally at 20, made according to the teachings of the invention. The floor tool is attached to an end of a wand 22 by a latch 24 on the tool, and an opposite end of the wand connects through a flexible hose to a vacuum cleaner (neither shown). In use of the floor tool, the wand is held by an operator to move the tool across a floor or surface to be cleaned. Although not shown, it is understood that the floor tool may be provided with a selected one of various attachments accommodating use of the tool in specialized applications. For example, the lower end of the floor tool could be provided with a squeegee for use of the tool in picking up water, oil and slurries from a floor, or with various types of shoes and/or brushes so that it may be used for cleaning carpets, for dust and fine debris removal or for cleaning grated or irregular surfaces.

The plastic floor tool 20 is configured to have an aerodynamically shaped interior chamber to improve a flow of air through the tool, so that air flows into the tool from every direction, a powerful vortex action is generated at floor level, suction is intensified and filth and debris are aerodynamically swept through the tool and wand into the vacuum cleaner. The chamber is configured so that debris is airswept at full force through smooth, contoured channels, and so that there are no acute bends in the channels to interrupt the smooth flow of air.

Conventionally, floor tools having aerodynamically shaped interior chambers are usually formed of sand cast aluminum. Because the tools are sand cast, the interior chamber shapes are relatively easy to form by using sand cores and then collapsing the sand to remove the cores. Such aluminum tools, while relatively heavy, do an effective job of cleaning, but because of the method of their manufacture, they are expensive to make.

In an effort to reduce the cost of floor tools, heavy steel and one piece lightweight plastic tools have been developed without aerodynamically shaped interior chambers, but rather with simple box-shaped chambers or, at best, chambers with smooth flowing edges. An aerodynamically shaped interior chamber is not formed in such tools because the materials used, steel and injection molded plastic, do not allow such chambers to be easily formed in tools that are initially fabricated as one piece structures. Thus, conventional steel and plastic floor tools may be made economically, but the absence of an aerodynamically shaped interior chamber in them significantly decreases their operating efficiency.

The plastic floor tool 20 of the invention, on the other hand, is not only lightweight, durable and economical to make, but also has within it an aerodynamically shaped interior chamber for improved operating efficiency. The chamber is configured much like or the same as those in aluminum tools, thereby to provide an enhanced air flow through the plastic floor tool that fully equals that obtained through aluminum tools. Providing the plastic floor tool with such a chamber is accomplished by initially injection molding two separate plastic housing pieces for the tool, which are then joined to form the floor tool. By virtue of initially forming the tool as two separate plastic pieces, each piece can be injection molded to a configuration defining a portion of the aerodynamic chamber, so that when joined together they form the floor tool with its inner aerodynamic chamber.

An injection molded top plastic piece 26 of the floor tool 20 is shown upside-down in FIG. 2 and includes a wall 28. A flange extends downwardly (upwardly in FIG. 2) from the wall slightly inwardly from the periphery thereof, and includes a front flange portion 30*a* that extends along the width of the wall, side flange portions 30*b* extending along the length of the wall and rear flange portions 30*c* that extend from the side portions along the width of the wall and have lengths on order of about 20–25% of that of the front portion 30*a*. Between facing ends of the flange portions 30*c*, the wall flares upwardly and rearwardly to a yoke portion 32. Extensions 34 having passages 36 are on opposite sides of the yoke portion.

Between inner facing ends of the flange portions 30*c*, and where the wall 28 flares upwardly and rearwardly, the wall has a lower surface 37 defining a portion 38 of the aerodynamic chamber of the floor tool 20. The top piece 26 is symmetrical to its opposite sides, and FIGS. 2A–2E show the cross sectional configuration of the top piece and of its aerodynamic chamber portion at various locations along the width of the piece.

Figure 3B:
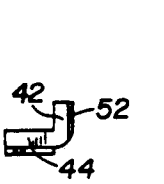
FIGS. 3B–3E are cross-sectional views taken substantially along the lines B—B through E—E of FIG. 3.
Figure 3C:
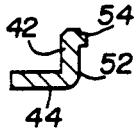
Figure 3D:
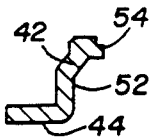
Figure 3E:
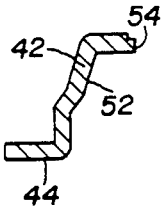
Figure 3:
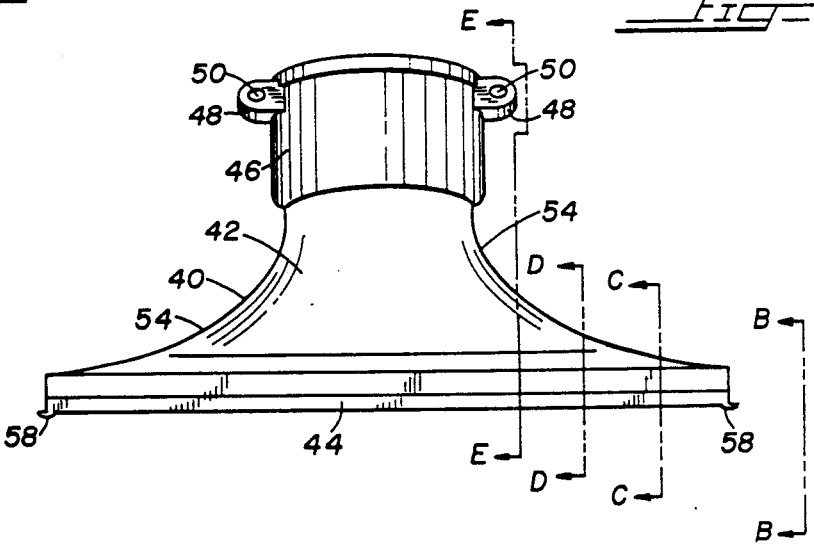
FIG. 3 is a bottom plan view of an injection molded plastic bottom piece of the floor tool.

An injection molded bottom plastic housing piece 40 of the floor tool 20 is shown upside-down in FIG. 3, and includes a wall 42 having a downwardly (upwardly in FIG. 3) extending flange 44 along its forward edge. Slightly rearwardly of the flange, opposite sides of the wall flare inwardly and rearwardly to a yoke portion 46, and extensions 48 having passages 50 are on opposite sides of the yoke portion. The bottom piece 40 is adapted to be joined to the top piece 26 to form the floor tool 20, and when it is an upper surface 52 of the wall 42 defines a portion of the aerodynamically shaped chamber within the tool. The bottom piece is symmetrical to its opposite sides, and FIGS. 3B–3E show the configuration of the bottom piece and of its aerodynamic chamber portion at various locations along its width. The section lines C—C to E—E of FIG. 3 will overlie and correspond to the section lines C—C to E—E of FIG. 2 when the bottom and top pieces are joined.

Figure 4:
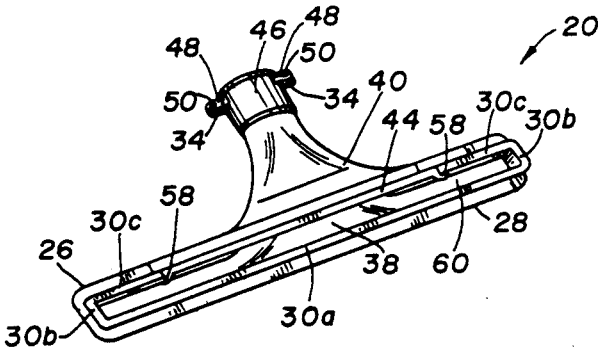
FIG. 4 is a bottom perspective view of the floor tool.

FIG. 4 shows the bottom plastic piece 40 placed on and joined to the top plastic piece 26 to form the floor tool 20. Side edges 54 of the bottom piece wall 42 abut side edges 56 of the top piece wall 28, with complementary shaped steps formed in the respective edges ensuring close mating relationship. The bottom piece flange 44 is between and in alignment with the top piece flanges 30*c*, with lips 58 at opposite ends of the flange 44 overlapping the flanges 30*c* to facilatate and ensure alignment. The yoke portion 46 and its extensions 48 overlie the yoke portion 32 and its extensions 34 to define a yoke for attaching the floor tool 20 to the end of the wand 22. The plastic bottom and top pieces are joined together by any suitable means to form an integral structure of the floor tool, such as by an adhesive or by heat flowing mating surfaces of the pieces. After the pieces are joined, fasteners (not shown) are extended through the yoke extension passages 36 and 50 to additionally strengthen the yoke for supporting the tool on the end of the wand.

With the initially separate top and bottom pieces 26 and 40 connected together, the plastic floor tool 20 comprises an integral, lightweight and durable structure. The flanges 30*a–c* and 44, which are adapted to carry attachments such as squeegees or brushes, define a generally rectangular air inlet opening 60 to the tool, through which air entrained matter is carried into the tool. Upon flowing through the opening, air enters the aerodynamically shaped interior chamber of the tool, which includes the space between the flanges and a centrally located enlarged chamber defined between the top and bottom pieces. Air entering opposite side ends of the opening flows generally laterally into the enlarged chamber, while air entering centrally of the opening flows directly into the chamber, and the chamber is configured to direct the air in a smooth flow to and through the yoke, which defines an outlet from the floor tool, and into the wand. The surfaces of the aerodynamic chamber are smoothly contoured and do not define any acute bends that could otherwise interfere with a smooth flow of air through the tool. As a result, suction is intensified at the opening 60 and debris to be vacuumed is efficiently aerodynamically swept through the tool to the vacuum cleaner.

While one embodiment of the invention has been described in detail, various modifications and other embodiments thereof may be devised by one skilled in the art without departing from the spirit and scope of the invention, as defined in the appended claims.

What is claimed is:

1. An improved floor tool for vacuum cleaning surfaces, comprising first and second injection molded plastic housings each configured to define portions of an air inlet to, an air outlet from and an interior air flow chamber of said floor tool, said first and second housings initially being formed as separate housings; and means for integrally joining said first and second housings to form said floor tool, said floor tool having said air inlet thereto, said air outlet therefrom and said interior air flow chamber between said air inlet and outlet, said interior air flow chamber having surfaces defining a smoothly contoured flow path for air between said air inlet and outlet, wherein said first and second housings each have flange portions which, when said housings are integrally joined, define an accessory supporting flange surrounding said air inlet to said floor tool.

2. An improved floor tool as in claim 1, wherein said first and second housings are injection molded to each have a yoke portion, said yoke portions, when said housings are integrally joined, defining a yoke of said floor tool for connecting said floor tool to a wand, said yoke comprising said floor tool air outlet.

3. An improved floor tool as in claim 2, including means accommodating mechanical fastening together of said first and second housing yoke portions to provide additional strength to said floor tool yoke for supporting said floor tool on the wand.

4. An improved floor tool as in claim 1, wherein said interior air flow chamber is configured so that said air flow path therethrough does not have any acute bends.

5. An improved floor tool as in claim 1, wherein said means for integrally joining said first and second housings comprises adhesive means.

6. An improved floor tool as in claim 1, wherein said means for integrally joining said first and second housings comprises a heat flowed plastic bond between mating surfaces of said housings.

7. An improved floor tool as in claim 1, wherein said first and second housings have mating surfaces when said housings are joined, and including complementary shaped stepped portions on at least a portion of each of said first and second housing mating surfaces, said stepped portions on said first and second housings being in mating and overlapping relationship when said housings are joined.

8. A method of making a plastic floor tool for vacuum cleaning surfaces, comprising the steps of injection molding first and second separate plastic housings to each have portions of an air inlet to, an air outlet from and an interior air flow chamber of the floor tool; and integrally joining the first and second plastic housings together to form the floor tool having the air inlet thereto, the air outlet therefrom and the interior air flow chamber between the air inlet and outlet, the interior air flow chamber having surfaces defining a smoothly contoured flow path for air between the air inlet and outlet, wherein said injection molding step injection molds the housings to have flange portions which, when the housings are integrally joined, form an accessory supporting flange around the air inlet to the floor tool.

9. A method as in claim 8, wherein said injection molding step injection molds the housings to have yoke portions which, when the housings are integrally joined, define a yoke of the floor tool for mounting the floor tool on a wand, the yoke also defining the air outlet from the floor tool.

10. A method as in claim 8, wherein said injection molding step molds the housings to have interior air flow chamber portions which, when the housings are integrally joined, form the interior air flow chamber of the floor tool without any acute bends in the air flow path through the chamber.

11. A method as in claim 8, wherein said integrally joining step comprises adhesively joining the housings.

12. A method as in claim 8, wherein said integrally joining step comprises heat forming a plastic bond between mating surfaces of the housings.

13. A method as in claim 8, wherein said injection molding step molds the housings to have complementary shaped stepped portions, and said integrally joining step includes placing the stepped portions of the housings in mating and overlapping relationship.

14. An improved floor tool for vacuum cleaning surfaces, comprising first and second injection molded plastic housings each configured to define portions of an air inlet to, and air outlet from and an interior air flow chamber of said floor tool, said first and second housings initially being formed as separate housings; and means for integrally joining said first and second housings to form said floor tool, said floor tool having said air inlet thereto, said air outlet therefrom and said interior air flow chamber between said air inlet and outlet, said interior air flow chamber having surfaces defining a smoothly contoured flow path for air between said air inlet and outlet, wherein said first and second housings are injection molded to each have a yoke portion, said yoke portions, when said housings are integrally joined, defining a yoke of said floor tool for connecting said floor tool to a wand, said yoke comprising said floor tool air outlet, and including means accommodating mechanical fastening together of said first and second housing yoke portions to provide additional strength to said floor tool yoke for supporting said floor tool on the wand.

* * * * *